United States Patent [19]

Lykes

[11] Patent Number: 4,526,305

[45] Date of Patent: Jul. 2, 1985

[54] APPARATUS FOR MANUALLY DISTRIBUTING POWDER GRANULES

[76] Inventor: Norman R. Lykes, P.O. Box 15505, Phoenix, Ariz. 85060

[21] Appl. No.: 470,971

[22] Filed: Mar. 1, 1983

Related U.S. Application Data

[63] Continuation-in-part of Ser. No. 223,249, Jan. 8, 1981, abandoned.

[51] Int. Cl.[3] ..... B65D 83/06

[52] U.S. Cl. ..... 222/632; 239/327

[58] Field of Search ..... 222/211-213, 222/215, 201, 631-634, 630; 239/323, 325, 327

[56] References Cited

U.S. PATENT DOCUMENTS

| | | | |
|---|---|---|---|
| 1,554,991 | 9/1925 | Crowley | 222/633 |
| 2,080,864 | 5/1937 | Hilts | 222/211 |
| 2,515,193 | 7/1950 | Chester | 222/633 |
| 2,580,580 | 1/1952 | Nicolle | 222/633 |
| 2,981,444 | 4/1961 | Root | 222/632 |
| 3,306,499 | 2/1967 | Lykes | 239/329 |
| 4,015,753 | 4/1977 | Bennett | 222/633 |

*Primary Examiner*—H. Grant Skaggs

*Attorney, Agent, or Firm*—Shields H. Gordon

[57] ABSTRACT

A squeezable container for fine, powder granules includes a plug in which air is mixed with the powder granules when the container is squeezed and a cap is disposed on top of the plug which allows the granules to be distributed out of the container. The plug includes slots through which the granules flow into the plug.

5 Claims, 13 Drawing Figures

APPARATUS FOR MANUALLY DISTRIBUTING POWDER GRANULES

CROSS-REFERENCE TO RELATED APPLICATIONS

This application is a continuation-in-part application of copending application Ser. No. 223,249, filed Jan. 8, 1981, and now abandoned.

BACKGROUND OF THE INVENTION

1. Field of the Invention

This invention relates to flexible containers used for storing and disseminating powdered materials, and, more particularly, to apparatus for disseminating powdered materials by a squeeze action on the container which causes air to be mixed with the powdered material and thus forced out of the container through an orifice or the like.

2. Description of the Prior Art

U.S. Pat. No. 2,515,193 discloses a powder sprayer which comprises a rubber bulb which holds the powder and a nozzle member which has a tubular portion extending downwardly into the bulb. There is a hole at the bottom of the tubular member and the powder flows through the hole, upwardly in the tubular member, and into a nozzle which has a larger diameter than the bore of the tube. The nozzle includes orifices through which the powder is sprayed out of the apparatus.

U.S. Pat. No. 2,896,825 discloses another type of dispensing apparatus. A tubular member having a plurality of holes extending through the tubular member is disposed within a deformable container. The tubular member communicates directly with a nozzle dispenser.

U.S. Pat. No. 2,981,444 discloses another type of squeezable container for dispensing powder. A feed tube is dispensed downwardly from a dispenser cap into the center of a deformable cylindrical container. The feed tube includes a plurality of holes through which the powder flows into the tube. From within the tube, the powder flows upwardly to a mixing chamber and out of the apparatus to the dispensing cap.

U.S. Pat. No. 3,263,873 discloses another type of spray dispensing apparatus in which a tubular member extends downwardly into a deformable container. The tubular member is offset from the center of the apparatus and communicates with a dispensing nozzle on the top of the container. Different sized apertures in the top dispenser can be aligned with the tube for dispensing different types of sprays or sprays of varying intensity.

U.S. Pat. No. 3,306,499, the inventor of which is the same as for the present application, describes apparatus for distributing powder from a squeezable container. Such apparatus is used for distributing powdered insecticides, such as diatomaceous earth, and the like. The purpose of the powdered material is to prevent insecticides from destroying plants. Since insects attack various parts of the plant, the powdered insecticide must be sprayed in various orientations of the container, up, down, sideways, (horizontal), etc.

U.S. Pat. No. 4,015,753 discloses another type of powder spray control apparatus which also uses a tube extending downwardly from the upper portion of a container. The tube communicates with a mixing chamber which is disposed between the top or upper portion of the tube and an orifice or discharge port. The powder flows upwardly in the tube and is mixed with air in the mixing chamber before being sprayed out of the apparatus.

U.S. Pat. No. 4,261,488 discloses another type of dispenser apparatus which includes the same type of mixing chamber and tube as disclosed in the '753 patent, but the feed of the powder to the tube is different than the '488 patent. A cup is disposed on the bottom of the tube, and powder flows into the cup and from the cup into the tube. The powder then rises in the tube, flows into the mixing chamber and then out of the apparatus. The cup also has a hole or bore at the bottom of the cup to facilitate the air and powder mixture flowing upwardly in the tube from the cup.

Since the powdered insecticide is generally very finely granulated material, in powder form, air must appropriately be mixed with the material to propel the material out of a container and onto the desired plant or plants, or wherever it is deemed advisable to spray the material. It is highly desirable to provide an even layer of material on the plant and accordingly the apparatus which distributes the powdered material must spray a uniform concentration of the material out of the container.

The '499 patent mentioned above performs most of the functions which are desirable through apparatus of this kind, as discussed in the preceding paragraph. The '499 apparatus includes a particular cap which has a swivel nozzle movable from an off-position to an on-position. In the on-position, the nozzle includes a bore which is aligned with a mixing plug and squeezing action of the container causes air and powder to mix and then to move out of the container through the aligned and open bore. A limitation of the '499 apparatus is that a limited amount of air and powdered material is disseminated from the container in virtually an unvarying or unchangeable quantity. Moreover, the cost of the swivel type cap is relatively expensive.

Insecticides, which may primarily be used for plants in gardens, may also be sprayed within a house, such as inside cupboards, around baseboards, and the like. The desired concentration of insecticide in powder form may vary for garden use, for baseboard use, and for cupboard use. That is, for outdoor or garden purposes, a large spray of powdered insecticide may be desirable. For interior, or baseboard purposes, a medium spray or concentration of the insecticide may be desirable. For the inside of cupboards, a fine spray may be desired.

The apparatus of the '499 patent, while effective, does not allow for the varying of the concentration of the powdered material which emanates from the cap except by manual application. That is, two or three squeezes of the container may be necessary to provide a relatively heavy spray, while one or two squeezes is used to provide a less amount of spray. A further control may be accomplished by the power exerted by the user's hand against the container. However, such manual operations are relatively inaccurate and inconsistent in the dispersal of the powdered insecticide with respect to the amount of concentration thereof.

The apparatus of the present invention provides a movable cap which allows the user to select the quantitative spray desired for various types of application of the insecticide disposed within the container.

SUMMARY OF THE INVENTION

The invention described and claimed herein comprises a squeezable or flexible container for a powdered insecticide having a plug for mixing air with the powdered insecticide disposed within the container and a cap movable on the plug to selectively allow the user to determine the quantity of insecticide sprayed from the container.

Among the objects of the present invention are the following:

To provide new and useful apparatus for disseminating powdered material;

To provide new and useful apparatus for selectively disseminating different quantities of air and granulated material;

To provide new and useful apparatus for mixing air and finely ground particulate matter;

To provide new and useful apparatus for selectively spraying various quantities of powdered material; and To provide new and useful apparatus for spraying selective quantities of powder by manually squeezing a container to mix the material within the container with air.

DESCRIPTION OF THE PREFERRED EMBODIMENT

Figure 1:
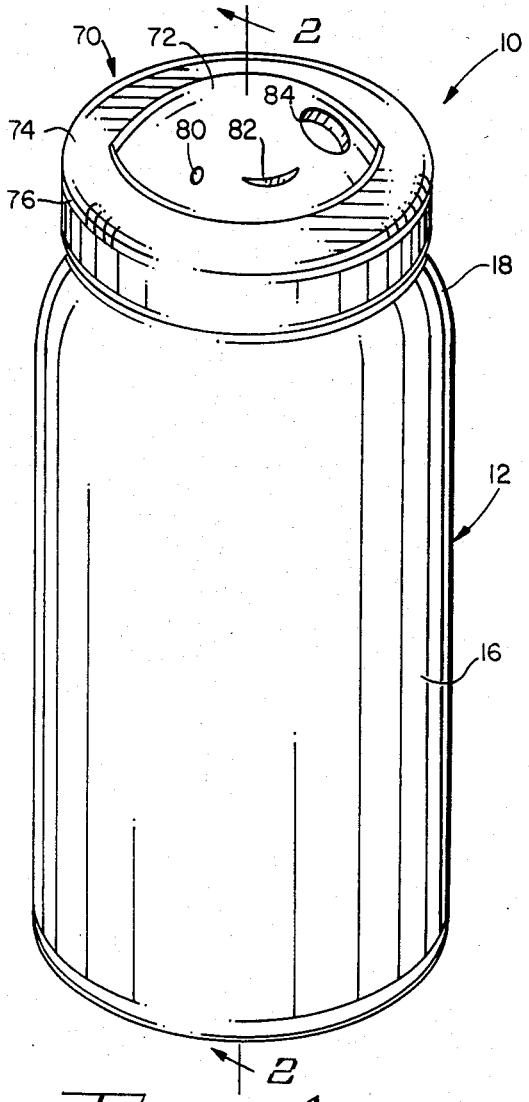
FIG. 1 is a perspective view of the apparatus of the present invention.

FIG. 1 is a perspective view of apparatus 10 for manually distributing powder or powdered granules. The apparatus includes a cylinder or container 12 which is relatively flexible and which contains the powder.

Figure 2:
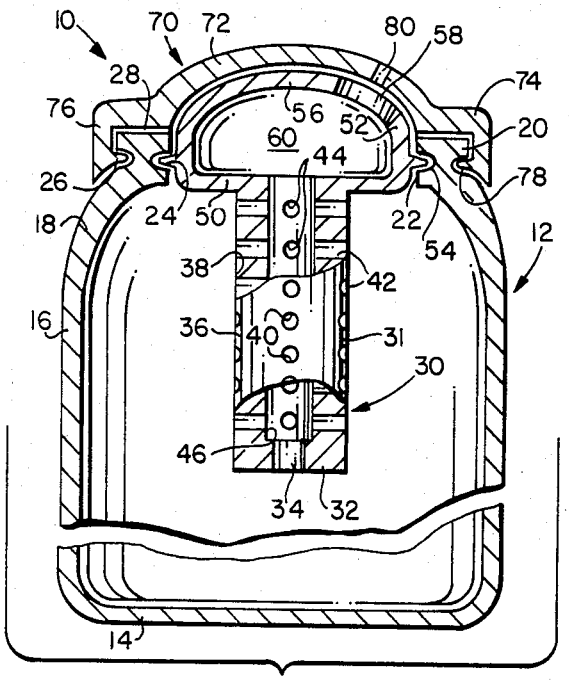
FIG. 2 is a view in partial section of the apparatus of FIG. 1, generally taken along line 2—2 of FIG. 1.
Figure 4:
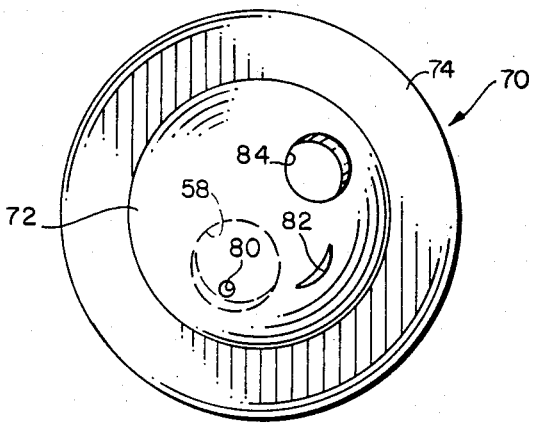
FIG. 4 is a top view of a portion of the apparatus of the present invention.
Figure 3:
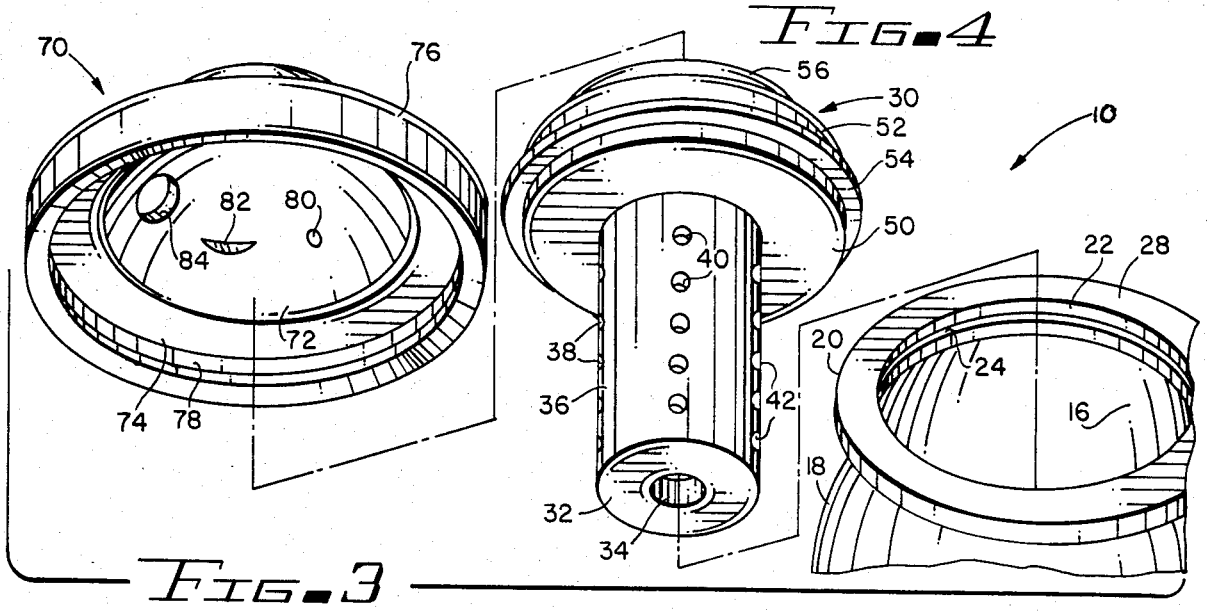
FIG. 3 is an exploded view of a portion of the apparatus of the present invention.

FIG. 2 is a view in partial section of the apparatus 10 of FIG. 1, taken generally along line 2—2 of FIG. 1. FIG. 3 is an exploded perspective view of a portion of the apparatus 10 of the present invention, showing the three primary components of the apparatus of the present invention, in perspective, separated from each other. FIG. 4 is a top view of a portion of the apparatus 10 of the present invention. For the following explanation, reference will be made to FIGS. 1, 2, 3, and 4.

The apparatus 10 for manually distributing powdered granules includes the cylinder 12. The cylinder 12 is flexible or squeezable, and a squeezing action by the hand of the user causes air within the cylinder 12 to mix with the powder granules also within the cylinder, as will be explained below. The squeezing effect causes air and powder to be sprayed or propelled outwardly from the apparatus 10. The cylinder 12 includes a bottom 14 and a cylinder wall 16 secured to and extending upwardly from the bottom 14. Spaced apart from the bottom or end wall 14, and at the upper portion of the cylinder wall 16, is an inwardly curved upper wall or shoulder 18. The upper wall or shoulder 18 extends inwardly, radially, as it extends upwardly. It terminates in a neck 20.

The interior of the neck 20 defines a mouth 22. Within the mouth 22 of the cylinder 12 is an interior, annular groove 24. The annular groove 24 extends radially inwardly with respect to the neck 20 from the mouth 22.

On the exterior portion of the neck 20 is an annularly extending exterior groove 26. The exterior groove 26 and the interior groove 24 cooperate respectively with a cap 70 and an insert or plug 30 to secure the cap and the plug or insert to the cylinder 12. The plug or insert 30 is a dispersant plug in which powder and air are mixed prior to their being propelled out of the apparatus. The air and powder are mixed together to provide an even dispersal of the powder in the air flow. This results in an even distribution of the powder out of the apparatus 10. As best shown in FIG. 2, the grooves 24 and 26 are aligned with each other and are generally concentric.

At the top of the neck 20 is a relatively flat surface or rim 28. The rim 28 is generally parallel to the bottom or end wall 14 of the cylinder 12.

The insert or plug 30 is disposed in the mouth 20 of the cylinder 12. The plug or insert includes a lower cylindrical portion 31 which extends downwardly into the interior of the cylinder 12. The cylindrical portion 31 includes a bottom or end wall 32 which has an aperture 34 extending therethrough.

Secured to the bottom 32, and extending upwardly therefrom, is a cylinder wall 36. The cylinder 31 includes four rows of apertures extending through the cylinder wall 36. The apertures are oriented vertically with respect to the end wall 32 and to each other. The rows of apertures are designated respectively by reference numerals 38, 40, 42, and 44. The apertures are preferably aligned with each other, as best shown in FIG. 2. By the term "aligned" is meant that the apertures of the respective rows are diametrically opposite each other.

Within the cylinder 31, and defined by the inner surface of the cylinder wall 36, is a central bore 46. The aperture 34 which extends through the bottom wall 32, and the rows of apertures 38, 40, 42, and 44, all communicate with the central bore 46. As will be discussed below, when the cylinder 12 is squeezed by a user, the total volume of the cylinder is reduced, thus causing compression of the air within the cylinder which in turn causes the powder or powdered granules within the cylinder to mix with the air. The air, under a slight compression, seeks a way out of the cylinder 12 so that the pressure within the cylinder and without the cylinder will be equalized. The air flows through the aperture 34 of the insert 30 and into the interior bore 46. The powdered granules flow through the vertical rows of apertures 38, 40, 42, and 44, and are mixed with the air flowing into the bore 46 through the aperture 34. The air and powder, together, flow out of the bore 46, as will be explained below.

Connected to the cylinder 31 is a top wall or flange 50 which extends radially outwardly from the upper portion of the cylinder 31 and which extends substantially perpendicularly to the longitudinal axis of the cylinder 31.

Extending upwardly from the top wall 50 at its outer periphery, and remote from the cylinder 31, is an upper cylinder wall 52. The cylinder wall 52 is relatively short, as compared with the overall length of the cylinder wall 36 of the cylinder 31.

A dome 56 covers the insert or plug 30. The dome 56 extends upwardly and inwardly from the top or upper portion of the upper cylinder wall 52. The dome 56 includes an aperture 58 which extends through the dome. As best shown in FIG. 2, the dome 56 is concave in its overall configuration, with respect to the plug 30. The exterior of the dome 56 is convex, and it cooperates with the cap 70, as will be discussed below.

Between the upper or top wall 50 of the insert or plug 30, and within the walls 52 and beneath the dome 56 is a chamber 60. The chamber 60 is a mixing chamber where the powder and the air are mixed, and where the mixing action between the air and the powder continues from the bore 46, prior to flowing outwardly through the hole or aperture 58. As best shown in FIG. 2, the diameter of the mixing chamber 60 is greater than the diameter of the bore 46 of the cylinder 31.

The cap 70 is secured to the neck 20 of the cylinder 12, oppositely from where the insert 30 is secured to the mouth 22, and it is disposed on top of the insert 30. The cap 70 and the insert or plug 30 cooperate to prevent deformation of the neck and mouth when the cylinder is squeezed and deformed for dispensing powdered granules. The cap 70 includes a dome top 72, the bottom portion of which defines a concavity which is disposed against the outer, convex surface of the dome 56 of the plug 30. The cap includes an outer, annular apron 74 which extends radially outwardly from the outer or lower portions of the dome 72. The bottom of the apron or flange 74 is disposed on the rim 28 of the container 12.

Extending downwardly from the annular apron 74 is a side 76. The side 76 is a relatively short, cylindrical portion which extends downwardly from the apron 74 and is disposed against the neck portion 20 of the cylinder 12. The side 76 includes an inwardly extending flange or bead 78. The bead 78 comprises a ridge which extends into the annular exterior groove or recess 26 of the neck 20 to secure the cap 70 to the cylinder 12.

As indicated above, the bottom of the dome 72 is a concave surface which engages or fits against the top of the dome 56 of the plug 30. The upper surface of the dome 56 and the bottom surface of the dome top 72 accordingly are in substantial engagement with each other.

The cap 70 may be rotated with respect to the cylinder 12 and the plug 30. By rotating the cap, the aperture 58, which extends through the dome 56 of the insert 30, may be aligned with any one of three spaced apart holes or apertures 80, 82, and 84 which extend through the dome 72. The holes or apertures 80, 82, and 84 are eccentrically disposed with respect to the cap 70 so that rotation of the cap brings the three apertures into consecutive alignment with the aperture 58. Selection of a particular aperture depends on the quantity or amount of powder desired to be sprayed.

The aperture 80 is a relatively small hole, and accordingly results in a small quantity of powder or powdered granules emanating from the container 12. The hole 84 is a relatively large hole, which may be substantially the same size or diameter as the aperture 58. When the hole 84 is lined up with the hole 58, a relatively large quantity of powder or powdered granules will emanate from the aligned holes upon the squeezing of the cylinder 12.

While the holes 80 and 84 are shown to be round, and the aperture or hole 82 is shown to be elongated, or more of a slot-shaped configuration, it is obvious that any desired configurations may be used for the apertures, depending on the type of powder spray desired from the apparatus 10. For example, if a user desires a relatively fine spray for the inside of cupboards, then the hole 80 will be aligned with the hole 58 on the dispersant plug 30 by rotation of the top 70 with respect to the cylinder 12 and to the plug 30. If a medium spray is desired, as for spraying baseboards of a home, or the area at the juncture of the walls and floors, then the aperture or hole 82 is aligned with the hole 58. For outdoor use, such as for gardens, a large spray is generally desired and accordingly the hole or aperture 84 is appropriately aligned with the hole 58 by rotation of the cap 70. The squeezing of the cylinder 12 results in the particular spray of the powdered material within the cylinder in accordance with the size of the hole in the cap lined up with the aperture in the dispersant plug 30.

The aperture 58 of the dispersant plug 30 is eccentric with respect to the longitudinal axis of the cylinder 30 of the plug and also with respect to the axis of rotation of the dome 56 of the plug. The three holes 80, 82, and 84 of the cap 70 are also eccentric so that upon rotation of the cap 70 the holes may be selectively aligned with the aperture 58. If desired, more than three holes or apertures may be cut through the dome 72, depending on the desires of the user with respect to the size or amount of the powder to be sprayed from the apparatus 10.

The cylinder or bottle 12 is preferably round for squeezing purposes. The overall length of the cylinder 12 may vary, depending on the quantity of powder or powdered granules desired to be disposed within the cylinder 12. The plug 30 comprises a dispersant plug for mixing the relatively fine powder within the cylinder 12 with air when the cylinder 12 is squeezed. The holes or apertures in the wall of the cylinder 12 of the plug 30 communicate with the central bore 46 of the plug 30 which defines a central mixing bore. It is within the bore 46 that the powder material is first mixed with air for the spraying or dispersing of the powder outwardly from the apparatus 10. The chamber 60, disposed above the bore 46, aids in the dispersion of the powder granules, such as diatomaceous earth, flowing into the chamber 60 from the bore 46. From the chamber 60, the powder particles, dispersed with the air flowing through the bore 56 and the chamber 60, flows outwardly from the apparatus 10 through the aperture 58 and the one of the holes or apertures 80, 82, or 84, that is aligned with the hole 58.

While the top of the chamber 60 is shown as rounded to define a convex outer surface and a concave inner surface, and the dome 72 is accordingly rounded to match the general configuration of the dome 56, it is obvious that the top or dome 57 and the top or dome 72 could be relatively flat, if desired. The rounded configuration of the dome appears to aid in the dispersion of the powder and the air and accordingly the rounded configuration is disclosed herein.

Figure 5:
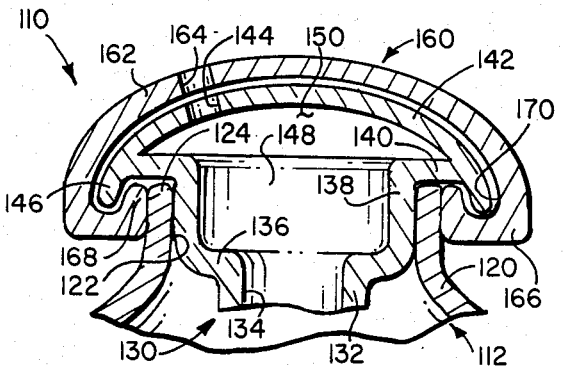
FIG. 5 is a view in partial section of an alternate embodiment of the apparatus of FIGS. 1–4.

FIG. 5 is a view in partial section of an alternate embodiment of the apparatus of FIGS. 1–4. The alternate embodiment includes a slight variation of an insert or dispersant plug 130 and an alternate embodiment of a cap 160, secured together to a flexible cylindrical container 112. The cylindrical container 112 is substantially identical to the cylindrical container 12 of the embodiment of FIGS. 1–4, except that the cylindrical container 112 includes a slightly different neck portion 120 and mouth portion 122, as compared to the neck and mouth portions of the cylinder 12 of the embodiment of FIGS. 1–4. The neck portion 120 of the cylinder 112 is generally smooth and continuous on the exterior, and the mouth portion 122 of the cylinder 112 is also generally smooth and continuous on its interior surface. The top of the cylinder terminates upwardly in a rim 124 at the top of the neck and mouth portions of the cylinder. The rim 124, like the neck and mouth portions 120 and 122, respectively, is also smooth.

The plug or dispersant insert 130 includes a lower cylindrical wall 132, only a portion of which, the upper portion, is shown in FIG. 5. The cylindrical wall 132 is substantially identical to the cylindrical portion 31 of the plug or insert 30, best shown in FIGS. 2 and 3. Appropriate apertures or holes extend through the cylinder wall 132, for the purposes as previously discussed. Within the cylinder wall 132 is an interior bore 134.

From the upper portion of the cylinder wall 132 is a circular, radially outwardly extending middle flange 136. Extending upwardly from the outer periphery of the middle flange 136 is an upper cylindrical wall 138. The upper cylindrical wall 138 coincides with the length of the mouth 122 of the cylinder 112. Extending radially outwardly from the top or upper portion of the upper cylindrical wall 138 is an upper flange 140. The upper flange 140 is disposed on the rim 124 of the cylinder 112. The flange 140 extends outwardly beyond the neck of the cylinder 112. A bore 148 is defined within the cylinder wall 138, above the flange 136 and below the flange 140.

The plug or insert 130 includes a dome 142 which is secured to and extends upwardly from the upper cylinder wall 138. The dome 142 is convex on the outside and concave on the inside. An aperture 134 extends through the dome 142, and is located eccentrically with respect to the longitudinal axis of the plug or insert 130 and also with respect to the longitudinal axis of the cylinder 112. The purpose of the aperture 144 is to allow the powder disposed within the cylinder 112 to flow outwardly, propelled by, and mixed with, air as the cylinder is squeezed. When the cylinder 112 returns to its original shape after being squeezed and deformed, air flows inwardly into the cylinder through the aperture 144. This action is substantially identical to the action of the air flow and dispersant with respect to the dome 56 and its aperture 58 of the apparatus 10, discussed above.

Extending downwardly beyond the upper radial flange 140 is a downwardly extending flange 146, which is a continuation of the dome 142. The flange 146 is spaced apart from the upper cylinder wall 138, and outwardly or beyond the neck 120 of the cylinder 112.

Beneath the dome, and above the middle flange 136 of the plug or insert 130, is a chamber 150. The chamber 150 includes two portions, a lower portion within the bore 148, defined within the upper cylinder wall 138, and an upper portion which is beneath the dome 142 and above the bore 148 and the upper radial flange 140.

A cap 160 covers the top of the plug or insert 130, and it is movable or rotatable on the cylinder 112 to allow any one of a plurality of apertures, only one of which is illustrated, to be aligned with the aperture 144 for dispersing a proper or desired flow of powder outwardly from the cylinder 112. The cap 160 includes a dome 162, which substantially covers the dome 142 of the plug or insert 130. The dome 162 includes a concave inner surface which receives the dome 142, including the downward flange 146. As indicated in FIG. 5, the curvature of the dome 142 in the flange 146 is continuous. The interior surface of the cap dome 162 is also accordingly continuous. Extending through the dome 162 is an aperture 164. The aperture 164 is shown aligned with the aperture 144 of the dome 142 to allow air-dispersed powder to flow through the aligned apertures 164 and 144 back into the cylinder 112. As illustrated in FIGS. 1, 3, and 4, there may also be other apertures extending through the dome 162 to provide a plurality of sizes of holes in the dome to allow different quantities of powder to flow out of the apparatus 110.

The cap 160 also includes a radially inwardly extending flange 166. The flange 166 extends radially inwardly from the lower or bottom portion or periphery of the dome 162. The inner periphery of the flange 166 has a diameter substantially the same as the outer diameter of the upper portion of the neck 120 of the cylinder 112.

Extending upwardly from the inner periphery of the inwardly extending flange 166 is an upwardly extending flange or ridge 168. The ridge 168 is relatively short in height. It defines a relatively short inner wall spaced apart from the lower portion of the dome 162. Between the flange 68, the lower, outer portion of the dome 162, and upwardly from the radial flange 166, is a groove 170. The groove 170 receives the lower flange 146 of the dome 142 of the plug 130.

The inner diameter of the upwardly extending flange 168 is substantially the same as the inner diameter of the radial flange 166 and the two inner diameters are substantially the same as the outer diameter of the neck 120 of the cylinder 112, against which they are disposed. The cylinder 112, the insert 130, and the cap 160 are accordingly secured together by the mutual cooperation of the various elements associated with the neck and mouth of the cylinder or container 112, including the upper cylinder wall 138, the radial flange 140, and the lower flange 146, all of the insert 130, and the flanges 166 and 168 and the lower portion of the dome 162, all of the cap 160, which define the grooves 170, into which extends the lower extension flange 146 of the dome 142.

Figure 7A:
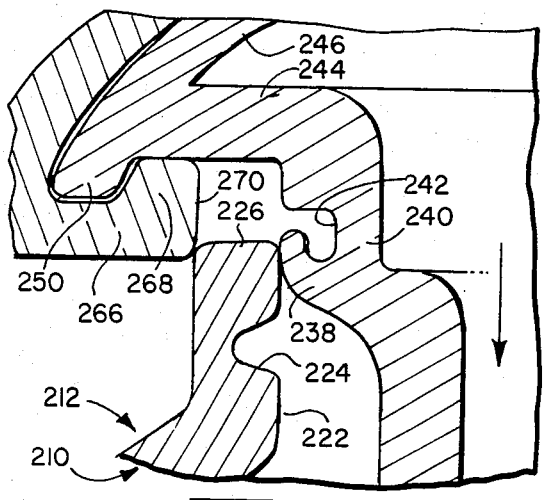
FIGS. 7A and 7B are enlarged views in partial section of the apparatus of FIG. 6 sequentially illustrating the assembly of the apparatus of FIG. 6, with FIG. 7B taken generally from the circle 7B of FIG. 6.
Figure 6:
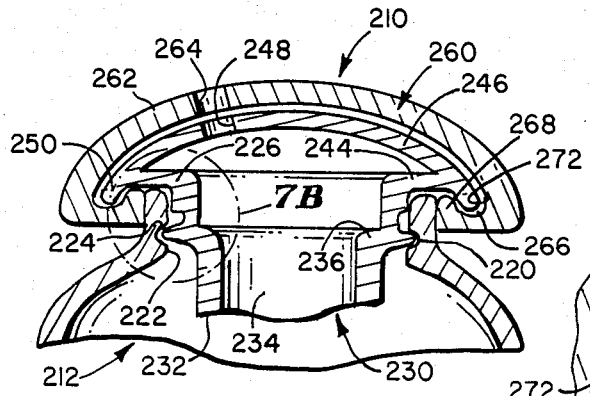
FIG. 6 is a view in partial section of another alternate embodiment of the apparatus of the present invention.
Figure 7B:
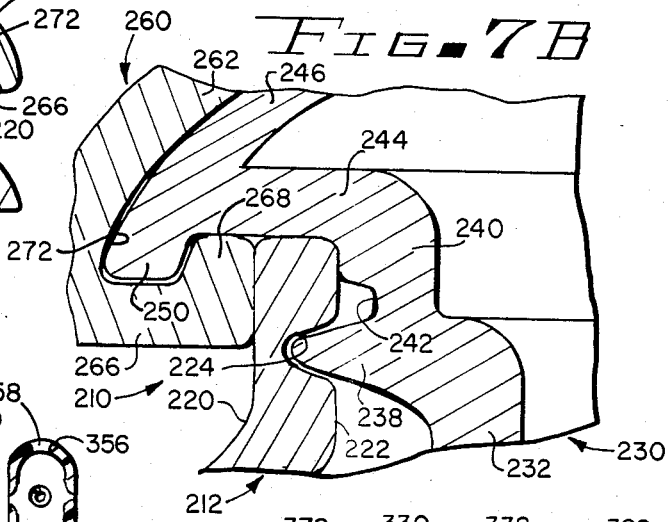

FIG. 6 is a view in partial section of another alternate embodiment of the apparatus of the present invention. FIG. 7A is an enlarged view in partial section of a portion of the apparatus of FIG. 6, illustrating the assembly of a plug 230 to a cylinder 212. FIG. 7B is also an enlarged view in partial section of a portion of the apparatus of FIG. 6, showing the sequential assembly operation of the insert or plug 230 to the cylinder 212, and following in sequence after the step illustrated in FIG. 7A. For the following discussion, reference will be made to FIGS. 6, 7A, and 7B.

Apparatus 210 includes a cylinder 212 which is similar to the cylinders discussed above in conjunction with the embodiments of FIGS. 1–5. A primary difference between the cylinder 212 of FIG. 6 and the cylinders 12 and 112 is in the neck and mouth area of the cylinder 212. The cylinder 212 includes a neck 220 and a mouth 222, the top rim of which is denoted by reference numeral 226. A circular or annularly extending groove 224 extends inwardly from the mouth 222 of the cylinder 212. The exterior of the neck 220 is smooth, similar to the neck 120 of the cylinder 112 shown in FIG. 5. The upper portion of the cylinder 212, and particularly of the mouth and neck portions of the cylinder 212, are generally cylindrical in configuration, as are the neck 120 and mouth 122 of the cylinder 112. The primary difference between the cylinders 112 and 212 is, as has been explained, the circularly extending groove 224 in the mouth 222 of the cylinder 212. The insert 230 is modified somewhat from the insert 130 of the embodiment of FIG. 5 to provide a locking engagement between the insert 230 and the groove 224 of the container or cylinder 212.

The apparatus 210 also includes a cap 260 which is substantially identical to the cap 160 of the embodiment of FIG. 5. The cap 260 has substantially the same relationship to the container or cylinder 212 and to the insert 230 as does the cap 160 with respect to the cylinder or container 112 and the plug or insert 130.

The insert 230 includes a vertically extending cylinder wall 232, through which the various apertures extend, substantially as illustrated in FIGS. 2 and 3 for the cylindrical portion 31 of the plug or insert 30. At the upper end of the cylindrical portion 232, and within the mouth 222 of the container or cylinder 212, the insert 230 includes a radially outwardly extending offset portion or web 236. The web 236 extends radially outwardly and is then joined by an upwardly extending cylinder wall 240. The cylinder wall 240 comprises a relatively short, upwardly or vertically extending cylindrical portion, generally parallel to the lower cylinder 232. Extending outwardly from the cylinder wall 240, and outwardly from the web portion 236, is an annularly or circularly extending ridge 238. The ridge 238 extends outwardly beyond the outer periphery or perimeter of the vertically extending cylindrical portion 240 and is received into the groove 224. The ridge 238, extending into the groove 224, provides a locking engagement to maintain the insert 230 within the container 212.

The outer portion of the cylindrical wall 240 includes a recess 242 into which the ridge 238, which is generally flexible, extends, as shown in FIG. 7A, as the insert 230 is moved downwardly within the container 210. The insert 230 is moved downwardly through the mouth 222 of the container, as indicated by the arrow, and as the ridge 238 contacts the rim 226 and the mouth 222, the ridge 238 bends or curves upwardly into the recess 242. The outer diameter of the wall 240 is substantially the same as the inner diameter of the mouth 222, and when the insert 230 is in place with respect to the container 212, as shown in FIG. 7B, the outer portion of the wall 240 is disposed against the inner periphery of the mouth 222, with the ridge 238 disposed within the groove 224.

Extending outwardly radially from the upper portion of the wall 240 is a radially outwardly extending upper flange 244. The bottom surface of the flange 244 is disposed on the top surface or rim 226 of the container 212 when the plug 230 is secured in place, as shown in FIG. 7B.

Connected to the outer periphery of the flange 244 is a dome 246, which is substantially identical to the dome 142 of the insert 130, shown in FIG. 5. The dome 246 includes an aperture 248, shown in FIG. 6, and a downwardly depending flange 250 which extends below the flange 244 to help secure the cap 210, the insert 230, and the cylinder 212 together.

The cap 260, as has been discussed above, is substantially identical to the cap 160 shown in FIG. 5. The cap 260 includes a dome 262, which is generally of a concave configuration on its interior surface and which concavity receives the dome 246 of the insert 230. The dome 262 includes an aperture 264, shown in FIG. 6 as being aligned with the aperture 248 of the dome 246. Squeezing of the cylinder or container 212, with a powder disposed within the flexible container or cylinder 212, causes the powder to be dispersed through the aligned apertures 248 and 246. As shown with respect tothe embodiment of FIGS. 1-4, the cap 260 preferably includes several apertures, each of a different size, to allow for different flows of powder out of the apparatus 210.

Extending radially inwardly from the lower portion of the dome 262 is an inwardly extending flange 266. The flange 266 terminates inwardly, spaced apart from the outer, lower periphery of the dome 262. A vertically upwardly extending flange or lip 268 is secured to the inner periphery of the flange 266. The inner periphery of both the flanges 266 and 268 define a relatively smooth wall 270 which bears against the outer periphery of the neck 220 of the cylinder 212, as has been discussed above.

Between the lower portion of the dome 262, the inner portion of the flange or lip 268, and the upper portion of the flange 266, is a groove or recess 272. The lower portion or flange 250 of the dome 246 extends into the groove or recess 272 to secure the three separate elements together, in substantially the same manner as has been discussed above in conjunction with the apparatus 110 of FIG. 5.

The general functioning of the apparatus 210 of FIGS. 6, 7A, and 7B, is substantially identical to the functioning of the apparatus 110 of FIG. 5 and to the functioning of the apparatus 10 of FIGS. 1-4. The cap 260 is movable or rotatable about the longitudinal axis of the cylinder 112 to align any of the eccentrically located apertures, such as the aperture 264, with the aperture 248 of the insert 230. Upon alignment of an aperture of the cap 260 with the aperture 248 of the plug or insert 230, a squeezing action on the cylinder or container 212 causes a flow of powder out of the aligned apertures. The outward flow results from the combination of the powder and air, as the two are mixed together and dispersed within and from the insert 230, in substantially the same manner as has been discussed above in conjunction with the apparatus 10 of FIGS. 1-4.

Figure 8:
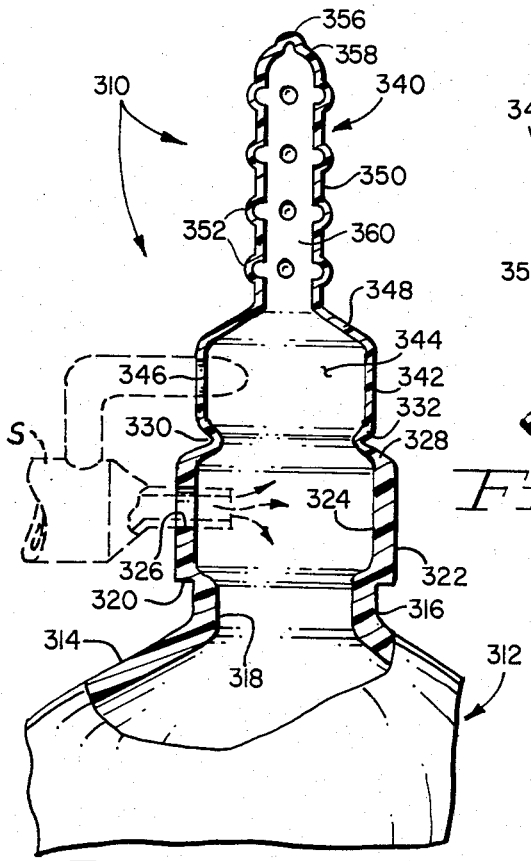
FIG. 8 is a view in partial section of an alternate embodiment of the apparatus of the present invention.
Figure 9:
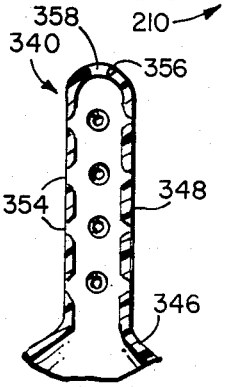
FIG. 9 is a view in partial section of the apparatus of FIG. 8.
Figure 10:
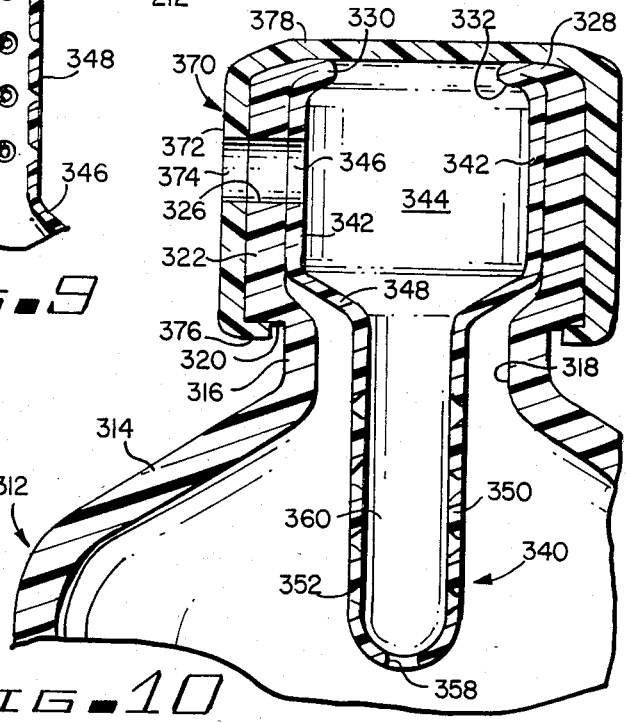
FIG. 10 is a view in partial section of the apparatus of FIG. 8 in its assembled configuration.

FIG. 8 comprises a view in partial section of an alternate embodiment of the apparatus of the present invention, namely an integral container apparatus 310. FIG. 9 is a view in partial section of a portion of the integral container apparatus 310 of FIG. 8. FIG. 10 is a view in partial section of the integral container apparatus 310 shown in its assembled or final use configuration.

The container apparatus 310 for distributing powdered granules includes a cylinder 312, which is the main cylinder into which the powder or powdered granules are disposed, secured to an integral plug 340. The term "integral" refers to the unitary structure of the cylinder 312 and the plug 340.

The cylinder 312 includes a sloping wall 314 disposed on the upper portion of the cylinder, similar to the cylinders disposed on the upper portion of the cylinder, similar to the cylinders discussed above in conjunction with FIGS. 1–7B. The sloping wall 314 terminates in a neck 316, the inner portion of which defines a mouth 318. Above the neck 316 is a radially outwardly extending shoulder 320 which comprises a connection portion between the lower cylinder 312 and an upper cylinder 322.

Within the upper cylinder 322 is a bore 324. The diameter of the cylinder 322 is slightly greater than that of the neck 316. Accordingly, the diameter of the cylinder bore 324 is slightly greater than the diameter of the mouth 318.

An aperture 326 extends through the wall of the cylinder 322. The aperture is used to fill the cylinder 312, as shown in phantom in FIG. 8. This will be discussed in more detail below.

At the upper portion of the cylinder 322 is an inwardly and upwardly sloping portion 328. It is secured to an upwardly and outwardly sloping portion 332 by a hinge portion 330. The plug 340 is in turn secured to the upwardly and outwardly sloping portion 322.

The plug 340 includes a cylinder 342, the height or overall length of which is slightly less than the height of the cylinder 322. The diameter of the cylinder 342 is also less than that of the cylinder 322. As shown in FIG. 10, the cylinder or cylindrical portion 342 fits within the cylinder 322.

The interior of the cylinder 342 defines a mixing chamber 344. The mixing chamber 344, as discussed above in conjunction with the previous embodiments, is a location in which air is mixed with the powder granules prior to the distribution of the granules outside the apparatus.

Extending through the cylinder wall 342 is an aperture 346. The aperture 346 is used in conjunction with the aperture 326 in the loading of the apparatus 310 with powder or powdered granules. This is shown in phantom in FIG. 8. The apertures 326 and 346 are also used for the distribution or dissemination of the powdered granules out of the apparatus 310, as will be discussed in conjunction with FIG. 10.

For loading purposes, a nozzle of the supply cylinder S, shown in phantom in FIG. 8, is inserted through the aperture 326. A plug, secured to the supply container S, is inserted into the aperture 346 to prevent the powdered granules from flowing out of the aperture 346 while the granules are flowing into the apparatus 310 through the nozzle of the supply cylinder S. The powdered granules, as shown by arrows in FIG. 8, flow from the supply cylinder or container S into the interior of the bore 324 of the container apparatus 310, and eventually come to rest in the cylinder 312.

Extending upwardly and inwardly from the cylinder 342 is a sloping wall 348. The sloping wall 348 terminates in a cylinder 350, which may be referred to as a lower cylinder, although in FIG. 8 it is disposed above the cylindrical container 312 and the cylinders 324 and 342. The lower cylinder 350 comprises the cylinder for the plug 340. In the manufacturing process, the cylinder 350 includes a plurality of outwardly extending bubbles 352, and an end bubble 356. The bottom of the cylinder 350 is closed by an end wall 358, which is generally rounded, as shown in FIGS. 8, 9, and 10. The bubbles 352 are disposed in a generally aligned configuration and in a regular pattern on the cylinder 350. The bubble 356 is disposed on the end wall 358. The bubbles extend convexly outwardly from the cylinder 350 and the end wall 358.

The purpose of the bubbles is to enhance the manufacturing capability in producing the integral container apparatus 310. When the bubbles 352 and 356 are removed from the plug 340, there remains a plurality of apertures 354 which extend through the cylinder 350 and an aperture 356 which extends through the end wall 358. The final configuration of the cylinder 350 of the plug 340 after the bubbles are removed, is shown in FIG. 9 and also in FIG. 10.

The plug 340, which includes the cylinder 342 and the cylinder 350, is preferably made of relatively flexible material, the thickness of which is somewhat less than the thickness of the cylinder 312 and the cylinder 322, in order to enhance the flexibility of the plug 340. After the bubbles 352 and 356 have been removed from the cylinder 350 and the end wall 358, reducing the cylinder 350 to the configuration shown in FIG. 9, the plug 340 is inverted within the cylinders 322 and 312, as shown in FIG. 10. The plug 340 folds on the hinge 330, with the sloping walls 328 and 332 disposed substantially against each other after the inversion has taken place. This is illustrated in FIG. 10. The cylinder 350 of the plug 340 extends downwardly, through the neck 318 and into the cylinder 312. The cylinder 342 of the plug 340 is shown in FIG. 10 disposed against the interior bore 324 of the cylinder 322, with the aperture 346 in the cylinder wall 342 aligned with the aperture 326 in the cylinder wall 322.

Particles or powder granules from within the cylinder 312, when a squeezing motion or action is applied to the cylinder 312, flow upwardly into the plug 340 through the aperture 358, along with a flow of air which moves through the apertures 352, and the granules and air flow into the mixing chamber 344. From the mixing chamber 344, the combination of air and particles flow out of the apparatus 310 through the aligned apertures 346 and 326.

A cap 370 is disposed about the cylinder 322. The cap 370 includes a cylinder wall 372 which is substantially the same as the cylinder 322 in general configuration. An aperture 372 extends through the wall 372, and is shown in FIG. 10 as aligned with the apertures 326 and 346. The aperture 374 is a delivery port or hole, and may be one of several different size ports or holes for the delivery of different quantities of powder or granules, as discussed above in conjunction with the other embodiments of the apparatus of the present invention.

At the bottom or lower portion of the cylinder 372 is a radially inwardly extending flange 376. The flange 376 is shown disposed against the shoulder 320 of the cylinder 322. The flange 376 thus secures the cap 370 to the cylinder 322 of the apparatus 310. The top of the cap 370 is defined by a dome 378 which extends over the top of the apparatus and against the inwardly sloping wall 328 of the cylinder 322, and covers the opening of the cylinder 342 where the cylinder 342 is secured to the cylinder 322. As shown in FIG. 10, the hinge 330 which connects the sloping portions 328 and 332 defines a large opening or mouth for the plug 340 and which is closed by the dome 378 of the cap 370. As in the other embodiments, the cap 370 may be rotated about the cylinder 322 to align various sized holes or ports, such as the hole or port 374, with the apertures 326 and 346 for the dispersal or spraying of the powdered granules disposed within the apparatus 310. The cap 370 is also used to close the aligned apertures 326 and 346 to prevent the invertent spraying of the powder out of the apparatus, when such spraying or dispersal is not desired.

Since the apparatus 310 comprises only two portions, with a cap separate from the integral cylinder and plug, the apparatus 310 lends itself well to automated manufacturing, reducing the complexity of the fabrication of the apparatus. However, the general concept of the apparatus 310 is substantially the same as that of apparatus 10 and apparatus 210, as discussed above in substantial detail. A plug is inserted into a container, with the plug having a mixing chamber in which the powder and air is mixed for ultimate spraying or dispersal out of the apparatus. By varying the sizes of the holes through which the powder or granules are sprayed, the quantity or flow of powder outwardly from the apparatus may be controlled for different types of applications.

The lower cylindrical portion 350 of the plug 340 is shown in FIGS. 8, 9, and 10 as being of a generally cylindrical configuration. For ease of inversion of the plug 340, the lower cylinder 350 may be tapered, as desired. A slight tapering of the lower cylinder may enhance the assembly of the apparatus by simplifying the inversion process. Similarly, a slight taper of the cylinder 342 of the plug 340 may also enhance the inversion of the plug.

The dome 378 of the cap 370 is shown in FIG. 6 as being generally flat on the top, covering the open portion of the cylinder 342 at the area of the hinge 330. If desired, and it may be preferable, the dome 378 may include a more rounded, concave configuration, such as included in the domes of the caps and plugs of the embodiments of FIGS. 1–7B. The rounded, inner concave configuration of the domes enhances the mixing of the granules and air within the upper, mixing chambers. However, as discussed above, mixing of the air and granules begins in the lower cylindrical portion of each plug, since the air within the container and the powder flows into the lower, cylindrical portions of the various plugs when the squeezing of the containers takes place. The mixing continues, for a more even dispersion of the powdered granules in the air, within the mixing chambers of the various embodiments.

Figure 11:
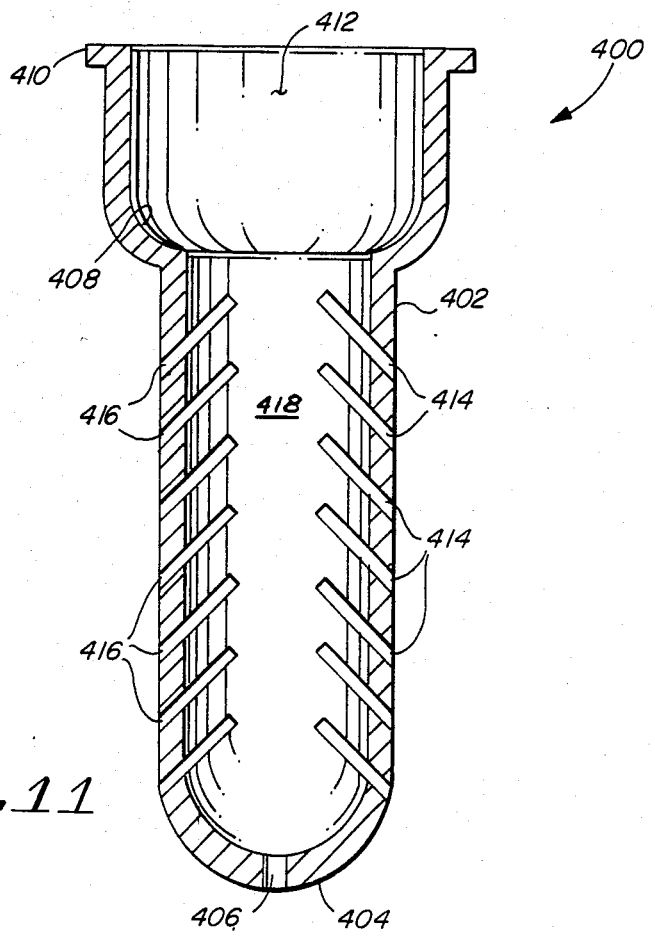
FIG. 11 is a view in partial section of another alternate embodiment of the apparatus of the present invention.
Figure 12:
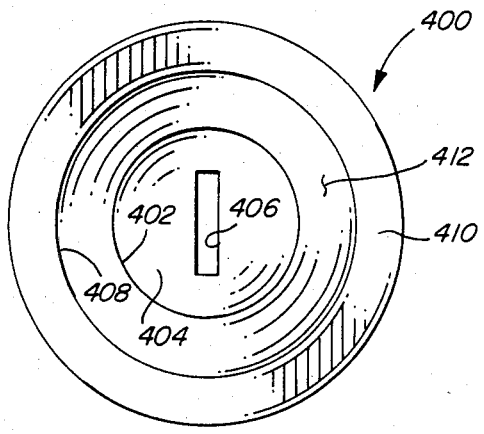
FIG. 12 is a top view of the apparatus of FIG. 11.

FIG. 11 is a view in partial section of an alternate embodiment 400 of the apparatus of the present invention. FIG. 12 is a top view of the apparatus 400 of FIG. 11. The apparatus 400 comprises an insert or plug, comparable to the insert or plug 30 of FIG. 1 in that it is insertable into a cylinder, such as the cylinder 12 of FIG. 1.

The insert or plug 400 includes a lower cylindrical portion 402 which extends downwardly from an upper cylinder or wall portion 408. The upper cylinder 408 includes a cylinder wall which is a continuation of the lower cylinder 402. Extending outwardly from the upper portion of the cylindrical wall 408 is a radially outwardly extending flange 410. The flange 410 may be adapted to extend into an annular interior groove, such as the groove 24 of the cylinder 10, best shown in FIG. 2.

A mixing chamber 412 is defined within the upper cylinder wall 408. It will be noted that the diameter of the upper portion of the cylinder or cylindrical wall 408, and thus of the mixing chamber 412, is substantially greater than the diameter of the lower cylindrical portion 402.

The lower cylinder 402 is elongated, and accordingly the length of the cylinder 402 is substantially greater than the length of the upper cylinder 408 and of the mixing chamber 412 therein. A rounded bottom 404 closes the bottom of the lower, elongated cylinder 402. There is a slot 406 which extends through the bottom 404. The slot 406 is a slotted aperture which extends generally diametrically with respect to the cylinder 402 and to the bottom 404. This is best shown in FIG. 12. Both air and powder may flow into the cylinder 402 through the slot 406. The slot 406 compares to the aperture 34 at the bottom of the plug or insert 30, discussed above in conjunction with FIGS. 1–3.

A plurality of angularly disposed slots 414 and 416 extends through the wall of the cylinder 402. The slots 414 and 416 are generally aligned opposite each other, or are diametrically opposite each other, as may be seen and understood from FIG. 12. The slots 414 and 416 are substantially identical to each other in their angular orientation. The slots 414 are generally parallel to each other, and the slots 416, on the opposite side of the cylinder 402 from the slots 414, are also parallel to each other. The slots 414 and 416 extend upwardly from the horizontal, with respect to the illustration of FIG. 11, at an angle of about 48° or 49°, or just slightly greater than 45°. The arcuate extent of the slots 414 and 416 is less than 180°.

Each of the slots 414 and 416 is generally "V" shaped in that it extends upwardly at an angle from a bottom apex. The bottom apexes of the slots are generally diametrically opposite each other, with the slots 414 on one side and the slots 416 diametrically opposite. Each V-shaped slot includes a bottom apex and two arms which extend upwardly from the bottom apex. It will be understood, of course, that since cylinder 402 is round, the slots 414 and 416 are actually arcuately extending on the round, cylindrical periphery of the lower cylinder 402. The slots extend upwardly and outwardly from their bottom apexes as they follow the curvature of the cylinder 402.

From the side, as shown in FIG. 11, the slots extend at a generally straight angle upwardly from the bottom apex of each slot. Thus, a flat plane could fit into the slots, and the angle of the plane would be about 48° or 49° upwardly from the horizontal.

While the bottom portion of the insert 400 is discussed as a cylinder 402, it may be understood that the bottom portion may alternatively include an inward taper to provide a generally conical configuration. Thus, the lower wall may taper inwardly as it extends downwardly from the upper cylindrical wall 408. In other respects, the apparatus will remain substantially as described, with the oppositely disposed slots extending upwardly from a bottom apex.

Regardless of whether the lower cylinder 402 is of a generally cylindrical configuration, as shown in FIGS. 11 and 12, or whether it is of a tapering configuration, the oppositely disposed rows of slots 414 and 416 preferably extend at the same general angle upwardly from the horizontal.

Within the cylinder 402 is an interior bore 418. The slots 414 and 416 extend arcuately on the wall of the cylinder 402 and allow communication between the exterior of the insert 400 and the interior bore 418. The overall length of each of the slots in the two rows of slots is preferably about the same. However, if the cylinder 402 has a taper to it, the extent of the slots may vary in accordance with the taper of the cylinder. However, in a straight cylinder, such as the lower cylinder 402, the extent of each slot is about the same.

While the embodiments of the plugs of FIGS. 2–10, as discussed above, shows holes or apertures which provide communication between the exterior of the plugs and the interior of the plugs, the rows of slots 414 and 416 provide a different type of communication. The powdered granules, mixed with air, from within the cylindrical container, such as the container 12 illustrated in FIGS. 1 and 2, flow directly inwardly through the holes in the plugs of FIGS. 2–10. The angularly extending slots of the plug 400 provide a different type of communication for the powdered granules and air. As indicated above, the powdered granules and air flow inwardly through the slots 414 and 416. The inward movement also includes an upward movement that helps to propel the mixture of air and powdered granules into the upper mixing chamber 412. The bottom slot 406 encourages a rush of air and powdered granules from the bottom axially upwardly within the cylinder 402 and within its bore 418 to further help in the upward movement of the air and powdered granules flowing into the bore 418 through the slots 414 and 416.

It will be noted that the slots 414 comprise one row of upwardly and inwardly extending angular slots, while the slots 416 comprise or define a second row of inwardly and upwardly extending slots. The two rows of slots are disposed opposite each other, as has been discussed above. The angular orientation of each of the slots is substantially the same. Each row is composed of a plurality of slots disposed in a vertically aligned manner, with the two rows oppositely aligned from each other.

When the plug 400 is inserted into a dispenser or container cylinder, such as a dispenser cylinder 12, and when an appropriate cap, such as the cap 70 of FIGS. 1, 2, 3, and 4, is secured to the dispenser cylinder, the appropriate squeezing of the resiliently deformable dispenser or container cylinder causes the powder or powdered granules contained within the dispenser cylinder, together with air, to flow upwardly into the plug 400 through the rows of slots 414 and 416. The air and powdered granules also flow upwardly through the elongated slot 406 and the bottom 404 of the cylinder 402. The air and powdered granules flow into the bore 418 of the cylinder 402 and continue their upward movement into the mixing chamber 412. From the mixing chamber 412, the air and powdered granules are dispensed outwardly through the cap.

It will be understood that the term "upwardly" as used herein is used in reference to the drawing, such as the drawing FIG. 11. The term "upward" denotes the flow of the powder or powdered granules and air relative to the plug or insert and to the exterior of the dispenser container or cylinder. The movement of the air and powdered granules within the container is a result of the squeezing of the dispenser container which increases the pressure of the air within the container. The increase in the pressure within the container over the atmospheric pressure on the exterior of the container causes the flow of the air and the powdered granules outwardly of the container. The outward flow is through a cap which communicates with the lower atmospheric pressure on the exterior of the dispenser container. Thus, the term "upward" refers to the direction of flow of the air which results from the squeezing action of a user on the container or dispenser that holds the powdered granules. It will be understood that the dispenser may be oriented in any appropriate direction, as desired, for the dispensing of the granules from within the container. The flow of air and granules will be directed inwardly with respect to the plug and towards the mixing chamber and outwardly through a cap regardless of the orientation of the dispenser.

The V-shaped slots 414 and 416, together with the elongated slot 406, which is oriented between the two rows of slots 414 and 416, provide a swirling action in the air and powder mixture which enhances the mixing of the air and the powder or powdered granules. The swirling action promotes the mixing and the even distribution of the powder in the air. In addition, there is less clogging of the powdered granules in the slots than with the round holes or apertures. That is, the employment of slots helps to eliminate the problem of clogging, which has been a real problem with the holes or apertures of the prior art. Together, the swirling action and the decrease in clogging helps to promote the efficiency of the distribution or dispensing of the powdered granules from a dispenser container.

In operation, a dispenser cylinder, such as the cylinder 12, is "filled" with the powdered granules. The term "filled" simply means that the entire container or cylinder is not filled, rather a "full" container is one in which the level of the powder is below the bottom of the plug. Before squeezing, a user should first shake the container to provide within the container or a dispenser a mist or cloud of powder (powdered granules) mixed with the air. The user then squeezes the container or dispenser cylinder so that the powder is sprayed or dispensed outwardly, as desired, and as discussed above.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Apparatus for dispensing powdered granules, comprising in combination:

container means for receiving powdered granules, including a deformably resilient wall for squeezing by a user;

plug means secured to and extending into the container means, including a lower cylinder disposed within the deformably resilient wall, a bore within the lower cylinder, angular slot means extending through the lower cylinder through which air and powdered granules flow into the bore, comprising a plurality of V-shaped slots, each having a bottom apex and arms extending upwardly from the bottom apex, and a mixing chamber of substantially greater diameter than the lower cylinder communicating with the bore for receiving the air and powdered granules from the bore and for mixing the air and powdered granules; and cap means secured to the container means, including an aperture through which the powdered granules and air are dispensed.

2. The apparatus of claim 1 in which the V-shaped slots are disposed in an aligned relationship.

3. The apparatus of claim 2 in which the V-shaped slots are aligned in an opposing relationship, with a first row of slots and a second row of slots, and the second row of slots is disposed opposite to the first row of slots.

4. Plug apparatus for a powdered granule dispenser, comprising, in combination:

a cylindrical mixing chamber adapted to be disposed within the dispenser in which air and powdered granules are mixed;

a cylinder secured to and disposed below the mixing chamber and having an internal diameter substantially less than the internal diameter of the mixing chamber; said cylinder being supported below the mixing chamber with the outer diameter of the cylinder being substantially less than the outer diameter of the mixing chamber; and slot means on the cylinder, including a plurality of V-shaped slots oriented generally parallel to each other and extending generally upwardly from a bottom portion through which air and powdered granules flow into the cylinder.

5. The apparatus of claim 4 in which the slot means further comprises a first row of slots and a second row of slots.

* * * * *